US011559079B2

(12) United States Patent
Prestia et al.

(10) Patent No.: US 11,559,079 B2
(45) Date of Patent: Jan. 24, 2023

(54) METHOD AND APPARATUS FOR INTRODUCING ELONGATED OBJECTS DEFINING A LONGITUDINAL AXIS INTO A CONTINUOUS FLOW OF MATERIAL

(71) Applicant: PHILIP MORRIS PRODUCTS S.A., Neuchatel (CH)

(72) Inventors: Ivan Prestia, Longara di Calderara di Reno (IT); Cristian Costarelli, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 331 days.

(21) Appl. No.: 16/062,668

(22) PCT Filed: Dec. 22, 2016

(86) PCT No.: PCT/EP2016/082293
§ 371 (c)(1),
(2) Date: Jun. 15, 2018

(87) PCT Pub. No.: WO2017/109026
PCT Pub. Date: Jun. 29, 2017

(65) Prior Publication Data

US 2018/0360104 A1 Dec. 20, 2018

(30) Foreign Application Priority Data

Dec. 23, 2015 (EP) ..... 15202596

(51) Int. Cl.
*A24D 3/02* (2006.01)

(52) U.S. Cl.
CPC ..... *A24D 3/0279* (2013.01); *A24D 3/02* (2013.01)

(58) Field of Classification Search
CPC ..... A24D 3/0279; A24D 3/02; A24C 5/1857; A24C 5/1885; A24C 5/325; A24C 5/327; A24C 5/328; A24C 5/478; A24C 5/52
See application file for complete search history.

(56) References Cited

U.S. PATENT DOCUMENTS 2,820,460 A * 1/1958 Bunzl ..... A24D 3/02 131/342
3,357,321 A * 12/1967 Hall ..... A24D 3/0225 493/47

(Continued)

FOREIGN PATENT DOCUMENTS

WO WO 2012/089343 7/2012
WO WO 2014/083094 6/2014

OTHER PUBLICATIONS

PCT Search Report and Written Opinion for PCT/EP2016/082293 dated Mar. 10, 2017 (9 pages).

*Primary Examiner* — Thomas M Wittenschlaeger
(74) *Attorney, Agent, or Firm* — Mueting Raasch Group

(57) ABSTRACT

The invention relates to a method for introducing elongated objects defining a longitudinal axis into a continuous flow of material, the method comprising the steps of: —providing a reservoir for holding the elongated objects to be introduced into the continuous flow of material; —introducing the elongated objects from the reservoir into a transfer chamber that is arranged such that the objects are aligned therein with their longitudinal axis parallel to each other; —moving the elongated objects along a direction parallel to their longitudinal axis in a single line path from the transfer chamber to a delivery channel by a rotatable wheel, the rotatable wheel arranged adjacent the transfer chamber and adapted to move the elongated objects located in the transfer chamber by contacting the elongated objects with a peripheral surface of the rotatable wheel; —inserting the elongated objects from (Continued)

the delivery channel to a location where the elongated objects are to be introduced into the continuous flow of material; and —regulating an insertion speed of insertion of the elongated object from the delivery channel to a location where the elongated objects are to be introduced into the continuous flow of material on the basis of a speed of the continuous flow of material at the location in which the elongated object is to be introduced.

15 Claims, 3 Drawing Sheets

(56) References Cited

U.S. PATENT DOCUMENTS 3,550,750 A * 12/1970 Jackson ..... A24D 3/0287 198/447
4,037,524 A * 7/1977 Hall ..... A24D 3/0279 493/48
4,043,454 A * 8/1977 Reuland ..... A24C 5/3412 209/571
4,086,846 A * 5/1978 Hall ..... A24C 5/34 493/16
4,238,994 A * 12/1980 Koch ..... A24C 5/31 250/559.4
4,287,979 A * 9/1981 Molins ..... A24D 3/0287 131/94
4,723,559 A * 2/1988 Labbe ..... A24C 5/52 131/94
6,540,063 B1 * 4/2003 Fallas ..... B65B 5/105 198/419.3
7,479,098 B2 * 1/2009 Thomas ..... A24D 3/0216 493/39
7,972,254 B2 * 7/2011 Stokes ..... A24D 3/025 493/39
8,475,348 B2 * 7/2013 Yanchev ..... A24D 3/0287 493/39
8,905,243 B2 * 12/2014 Dixon ..... B07B 13/10 209/640
9,198,461 B2 * 12/2015 Hoffmann ..... A24D 3/0287
9,295,284 B2 * 3/2016 Prestia ..... A24D 3/025
9,622,510 B2 * 4/2017 Mamerski ..... A24D 3/0287
2004/0020554 A1 * 2/2004 Smith ..... B65B 1/366 141/67
2005/0070409 A1 * 3/2005 Deal ..... A24D 3/0216 493/44
2006/0135335 A1 * 6/2006 Dawson ..... A24D 3/0216 493/39
2007/0117700 A1 * 5/2007 Kushihashi ..... A24D 3/0295 493/39
2010/0184576 A1 * 7/2010 Prestia ..... A24D 3/061 493/39
2012/0073935 A1 * 3/2012 Cieslikowski ..... A24D 3/0287 198/418
2019/0000132 A1 * 1/2019 Prestia ..... A24C 5/325

* cited by examiner

METHOD AND APPARATUS FOR INTRODUCING ELONGATED OBJECTS DEFINING A LONGITUDINAL AXIS INTO A CONTINUOUS FLOW OF MATERIAL

This application is a U.S. National Stage Application of International Application No. PCT/EP2016/082293 filed Dec. 22, 2016, which was published in English on Jun. 29, 2017, as International Publication No. WO 2017/109026 A1. International Application No. PCT/EP2016/082293 claims priority to European Application No. 15202596.1 filed Dec. 23, 2015.

The present invention relates to a method and an apparatus for introducing elongated objects defining a longitudinal axis into a continuous flow of material, for example for the manufacture of hollow filters or hollow filter components. The hollow filters or hollow filter components are preferably used in an aerosol-forming article.

The production of filter rods starts from a filter material made of a mixture of various ingredients. The raw material for the manufacture of cigarette filters is commonly cellulose, for example obtained from wood. The cellulose is then acetylated, making it into a material called cellulose acetate or simply "acetate" for short, dissolved, and spun as continuous synthetic fibers arranged into a bundle called tow. This tow is generally opened, plasticized, shaped, and cut to length to act as a filter. The plasticizer dissolves the cellulose acetate fibers so that they stick together in a single unit by the action of pressure and heat so that the filter material solidifies and the filter rod is formed. Filters are commonly wrapped in a wrapping material, which in many cases includes a strip of paper.

Also the production of filters which are non-wrapped in the wrapping paper, is known. In the production of non-wrapped filter plugs, the filter material is shaped in the desired form in a forming unit. The material used and the process of shaping are so realized that the filter rod maintains its shape even after leaving the forming unit to a sufficient degree, so that the wrapping paper—otherwise used for shape stabilization—can be omitted. During the production of non-wrapped filter plugs, the filter material stream in the forming unit is subjected to pressure and heat. The necessary thermal energy can be introduced in various ways into the filter material, for example by hot-air, such as steam, or microwave energy.

Further, it is known to produce hollow filters, that is, filters which include a through hole passing through the filter along its longitudinal axis.

In order to form the hollow filter, a tube is inserted into the filter material to delimit the through hole formed therein. As an example, the tube can be a carton tube. In known processes to produce hollow filters, the tubes are inserted manually into the flow of filter material. However, the manual insertion of the tubes leads to a relatively slow manufacturing process due to the fact that an operator needs to insert the tubes one by one. Further, the rejection rate may be high due to the relatively low accuracy that a manual insertion can achieve.

There is therefore a need for a process and an apparatus for introducing elongated objects defining a longitudinal axis into a continuous flow of material, such as the tubes into the filter material, for example for manufacturing filters or filter components having an internal through hole, which has a relatively high speed and with a relatively low waste material production. Therefore, there is also a need of increasing the productivity of the process and apparatus producing the hollow filters.

The invention may satisfy at least one of the above needs.

The invention relates to a method for introducing elongated objects defining a longitudinal axis into a continuous flow of material, the method comprising the steps of: providing a reservoir for holding the elongated objects to be introduced into the continuous flow of material; introducing the elongated objects from the reservoir into a transfer chamber that is arranged such that the objects are aligned therein with their longitudinal axis parallel to each other; moving the elongated objects along a direction parallel to their longitudinal axis in a single line path from the transfer chamber to a delivery channel by a rotatable wheel, the rotatable wheel being arranged adjacent the transfer chamber and adapted to move the elongated objects located in the transfer chamber by contacting the elongated objects with a peripheral surface of the rotatable wheel; inserting the elongated objects from the delivery channel to a location where the elongated objects are to be introduced into the continuous flow of material; and regulating an insertion speed of insertion of the elongated object from the delivery channel to a location where the elongated objects are to be introduced into the continuous flow of material on the basis of a speed of the continuous flow of material at the location in which the elongated object is to be introduced.

According to the method of the invention, an elongated object can be inserted into a flow of material so that it becomes part of the flow. For example, the elongated object could be a tube so as to form a hollow filter body together with filter tow material. The flow of material may take place in a filter maker. The automatic insertion and the control of the speed of the insertion of the elongated object into the flow of material depending on the speed of the flow of material itself allows keeping the processing speed of the filter maker unaltered, because the insertion speed can be adapted to the filter material flow speed. The transfer chamber is arranged in such a way that the elongated objects are aligned therein with their longitudinal axes parallel to each other: they can be therefore fed to the rotatable wheel which moves the elongated objects along a direction parallel to their longitudinal axis in a single line path from the transfer chamber to the delivery channel. This "feeding apparatus" therefore is apt to receive the non-oriented elongated objects, to orient and to convey them at a high output rate and in a flawless manner to the flow of material where they have to be inserted, without interruption.

The elongated object might be a tube or any hollow material defining a longitudinal axis. The tube may be formed in carton, in plastic, preferably including a single layer or multiple layers made of the same material or with a combination of layers made of different materials.

The flow of material is preferably a flow of filter material, that is, a flow of material used to realize a filter. The filter material which is used to realize a hollow filter body may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the filter material comprises cellulose acetate tow.

The filter material may include additional material, either in a final filter segment or in one or more additional elements incorporated in the filter. For example, the additional material may be incorporated into fibrous filter tow of the filter segment or in an additional filter element. For example, the filter material may include a sorbent material. The term "sorbent" refers to an adsorbent, an absorbent, or a substance that may perform both of these functions. The sorbent material may comprise activated carbon. The sorbent may be incorporated into the filter segment in which the capsule is embedded. More preferably, however, the sorbent is incorporated into an additional filter element upstream of the filter segment. Alternatively or additionally, the filter material may include an adhesive, a plasticizer or flavor release agent, or a combination thereof.

Preferably, the filter material includes a plasticizer, which has the function of a bonding constituent. In hollow filters components, the component includes a through hole which weakens the overall structure of the filter plug. In order to avoid deformations of the hollow filter component, for example by compression of the filter, it is preferred that the material in which the hollow filter is realized is stiffer than the material in which a standard filter plug is formed. For this purpose, a procedure similar to that used for the production of non-wrapped filters is preferably used also for the production of hollow filters, which can be wrapped or not.

Preferably, the filter material is a filter tow material.

Elongated objects are herewith considered as objects having a dimension which is preponderant with respect to the others. Any geometry of the object can be considered. For example, an elongated object can be a cylinder having a diameter which is smaller than its height. The longitudinal axis of the elongated object is directed along its major dimension. The longitudinal axis needs not to be a symmetry axis.

Filters including elongated objects and realized with the process of the invention may advantageously be used in aerosol-forming articles. Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

In the process of the invention, a reservoir is provided for holding the elongated objects to be introduced into the continuous flow of material. The elongated objects, such as the tubes, are introduced in the reservoir for example by an operator or automatically by a machine. The size of the reservoir is preferably adapted to the size of the elongated objects, so that the same reservoir and apparatus can be used with different elongated objects. Preferably, in a single production batch, all elongated objects have the same length along their longitudinal axis. Due to the fact that the elongated objects when introduced in the reservoir can have their longitudinal axes randomly oriented, that is, the longitudinal axes of the elongated object may form any angle with a given fixed axis, the elongated objects are introduced from the reservoir into a transfer chamber, which is arranged in such a way that the elongated objects contained therein are aligned therein with their longitudinal axes parallel to each other. Inside the transfer chamber therefore, the longitudinal axes of the elongated objects become substantially parallel to each other or only with a small deviation from parallelism. In this way, it is easier to handle the elongated object and to insert them in the flow of material when their orientation is pre-determined and the same among them.

Once the elongated objects are substantially aligned, they exit the transfer chamber. In order to be inserted one after the other in the flow of material, preferably without big gaps or interruptions, the elongated objects are then aligned along a single line path. Therefore, in order to separate each of the elongated objects from the others, the elongated objects are preferably moved along a direction parallel to their longitudinal axis from the transfer chamber to a delivery channel by a rotatable wheel one by one. The rotatable wheel transfers a single elongated object per time unit from the transfer channel to the delivery channel and places them one next to the others, forming in this way a single line path, where the elongated objects are aligned one after the other with their longitudinal axes parallel to each other. The rotatable wheel may accelerate the elongated objects so that they acquire a certain speed along the single line path. In order to accelerate the elongated objects, the rotatable wheel arranged adjacent the transfer chamber may move the elongated objects located in the transfer chamber by making contact with them by means of its peripheral surface.

The aligned elongated objects which have a certain speed given by the wheel are inserted into the flow of material so that the final object, such as a filter, can be realized.

According to the invention, the speed of insertion of the elongated object into the flow of material is further regulated so that the speed of insertion becomes dependent on the speed of the flow of material, that is, it is linked to the speed of the material in which the elongated objects is introduced, at the location or point of introduction.

In this way, the elongated objects are automatically inserted one by one in the flow of material adjusting the insertion speed to the speed of the flow of material and therefore adapting the insertion speed to the speed of the machine further processing the flow of material in which the elongated objects are inserted, such as a filter maker. Due to the continuous insertion of elongated objects placed in a single line path, no interruption or very limited interruptions in the process may be needed. An improvement in production may be therefore achieved. No reduction of speed of the filter maker may be needed, increasing productivity.

Preferably, the method comprises the step of regulating a rotational speed of the rotatable wheel so that the elongated objects in their motion in a direction parallel to their longitudinal axes in a single line path from the transfer chamber to a delivery channel are accelerated to a speed equal to or higher than the speed of the continuous flow of material at the location in which the elongated object is to be introduced. The first acceleration of the elongated object from their resting position may be given by the rotatable wheel. The elongated object may be moved by the wheel, with a combination of the friction between the rotating wheel and the vacuum created inside the wheel with a dedicated vacuum pump, that create attraction and contact between the surface of the wheel and the elongated object. Preferably, this speed is already similar to the speed of the flow of material so that the last speed control before insertion in such a flow is substantially only a limited adjustment of the speed of the elongated objects. In this way the possibility of errors in the insertion speed may be minimized.

Preferably, the method includes measuring a distance in the delivery channel between two adjacent elongated objects in the single line path; and changing a rotational speed of the rotatable wheel depending on the measured distance. In order to obtain a proper insertion of the elongated objects into the flow of material, the elongated objects along the single line path are preferably tightly packed along their longitudinal axes, that is, preferably an axial end of an elongated object substantially is in contact to an axial end of the subsequent or precedent elongated object in the line path, or only a small distance is present between the two. The minimum desired distance is preferably less than the length of one finished product where the elongated objects are used, such as the length of a filter in which the elongated object delimits the inner whole, in order to reject the minimum number of filters without a portion of elongated object inside. The distance between the elongated objects along the single line path is preferably measured so that, when this distance is considered too large, for example comparing the measured distance with a desired threshold, the rotational speed of the wheel may be varied, for example, it may be increased.

Preferably, the method comprises vibrating the elongated objects in the transfer chamber. Preferably the transfer chamber is shaped as a hopper. The movements of the hopper or of any vibration means inside the hopper so that the elongated objects vibrate may enable changing the orientation of the objects in the hopper, such that the elongated objects are aligning to each other. Further, preferably, the transfer chamber may include an exit hole. The exit hole may be used to transfer the elongated objects from the hopper to the wheel. Preferably, the hole is at the lower end of the hopper, such that the objects in the hopper are moving towards the hole by means of gravitational forces. Typically, a non-spherical object, like for example a cylindrical object, requires a certain orientation to be able to enter into the hole. The vibration of the hopper or of the vibration means may not only facilitate the movement of the objects in the direction of the exit hole, but may also help to reorient the objects, such that at least some of the elongated objects are in an orientation that allows them to be received by the hole. Particularly, the exit hole may have a cross-section, which corresponds to the cross-section of the object in one direction, wherein the cross-section of the hole is slightly larger than said cross-section of the object. Thus, the combination of the hopper, the vibration and the hole may enable orienting the elongated objects from a completely random orientation to a more oriented state. For the aforementioned cylindrical object, only two orientations are possible within the exit hole, a first orientation and a second orientation where the object is aligned parallel to an object in the first orientation but into an opposite direction. Where the cylindrical elongated object is symmetrical along its longitudinal axis, there is no difference between the object in the first orientation and the second orientation.

In a preferred embodiment, the hole is adapted to receive objects that are substantially cylindrical with a diameter that is smaller than the axial length of the objects. The hole has a diameter that is at least slightly larger than the diameter of the objects, but smaller than the axial length of the objects. In case the object is a cylindrical object, that has a length that is larger than its diameter, the hole preferably has a circular cross-section, which is slightly larger than the diameter of the cylindrical object, such that the cylindrical object fits only lengthwise in the hole.

Preferably, the step of regulating an insertion speed of insertion of the elongated object from the delivery channel to a location where the elongated objects are to be introduced comprises regulating the insertion speed so that it is substantially identical to the speed of the continuous flow of material at the location in which the elongated object is to be introduced. In this way, the speed of the elongated objects and the speed of the flow of material is substantially the same, and nor reduction of speed of the flow of material is needed for a proper insertion of the elongated object therein.

Preferably, the step of contacting the elongated objects with a peripheral surface of the rotatable wheel comprises sucking the elongated object against the peripheral surface of the rotatable wheel. Preferably, the wheel enables to move the elongated objects, such as cylindrical objects, along a direction which becomes the line path. The wheel provides the benefit of moving the elongated objects in a controlled manner to enable their substantially exact speed at the end of the rotation around its axis. The wheel in its radial or peripheral surface may comprise a set of slots, which are arranged at different radial positions and in radial alignment with each other. The slots are adapted to create vacuum so that they attract the elongated objects towards the radial or peripheral surface of the wheel and force the acceleration of the elongated object which becomes attached to the wheel's peripheral surface.

Preferably, the method of the invention comprises changing a length of the reservoir on the basis of a length of the elongated object along the longitudinal axis. In this way, the reservoir is adapted to receive elongated objects having different lengths along the longitudinal axis.

The invention also relates to an apparatus for introducing elongated objects defining a longitudinal axis into a continuous flow of material, the apparatus comprising: a reservoir for holding the elongated objects to be introduced into the continuous flow of material; a transfer chamber connected to the reservoir and arranged such that the objects are aligned therein with their longitudinal axis parallel to each other; a rotatable wheel having a peripheral surface, the wheel being arranged adjacent the transfer chamber and adapted to move the elongated objects located in the transfer chamber to a delivery channel in a single line path along a direction parallel to their longitudinal axis by contacting the elongated objects with a peripheral surface of the rotatable wheel; the delivery channel connecting an outlet of the rotatable wheel to a location where the elongated objects are to be introduced into the continuous flow of material; and means to regulate an insertion speed of insertion of the elongated objects from the delivery channel to a location where the elongated objects are to be introduced into the continuous flow of material on the basis of a speed of the continuous flow of material at the location in which the elongated object is to be introduced.

The advantages of this apparatus have been already outlined with reference to the above method and are not repeated herewith.

The apparatus of the invention may work in combination for example with a filter maker. For example, the flow of material is a flow of filter material and, in order to shape the filter material and the inserted elongated object into a filter body further used for the production of filters, a forming device connected to a terminating end of the feed path and adapted to form the filter material and the inserted elongated object into a rod-shaped filter body and deliver the formed continuous filter body is used. The forming device comprises a tubular forming element adapted to allow the filter material and the inserted elongated object to pass therethrough to form the filter material into the continuous filter body. The inner walls of the tubular forming element preferably define the outer surface of the continuous filter body and determine, among others, its diameter. The inner walls of the tubular element "compress" the filter material into a rod.

Advantageously, the tubular element defines an internal channel substantially of cylindrical cross section, having a longitudinal axis, connecting an inlet of the tubular element to an outlet of the same. The feed path preferably terminates at the inlet of the tubular element.

Preferably, the peripheral surface of the rotatable wheels includes one or more suction openings for generating a negative pressure causing the elongated object to move towards the peripheral surface of the transfer wheel. In this way, a speed or acceleration can be imparted by the wheel to the elongated object which may adhere to the surface of the wheel at least for a given time.

Contact between surface of wheel and elongated object may be done with a combination of the shape of the external diameter of the wheel and the suction inside the wheel. When the elongated object is passing over the wheel, contact is missed and the object is free to move to next stage.

Preferably, the apparatus includes a sensor system connected to the delivery channel adapted to measure the distance between two adjacent objects in a single line transported therein. More preferably, this sensor is connected to a speed regulating means of the rotatable wheel. In this way, the speed of the wheel may be regulated so that the distance between two adjacent elongated objects in the same line path is kept relatively small, usually below the length of one finished product, such as one finished filter.

Preferably, the means to regulate the insertion speed comprise one or more pulleys. Preferably, a first and a second pulley are used. The first pulley has the same linear speed as the rotatable wheel. The second pulley may be retro-actioned by the software in order to reach the correct distance between the elongated objects and the desired speed. One or more additional pulley of smaller size may be introduced on top of the first or the second pulley, or both, in order to guarantee contact of the elongated object with the motorized pulleys.

Preferably, the delivery channel comprises a guiding rail to guide the elongated objects in a single line path to the location where the elongated objects are to be introduced into the continuous flow of material. In this way, the insertion of elongated objects in the flow of material is substantially continuous and the number of finished objects, that is, objects that includes the inserted elongated object, which need to be discarded due to the absence of the inserted elongated object is minimized.

Preferably, the apparatus comprises means to regulate a rotational speed of the rotatable wheel. As mentioned, preferably these means are connected to the sensor to detect the distance between two consecutive elongated object in the line path.

The invention will be further described, by way of example only, with reference to the accompanying drawings in which:

FIG. 1 depicts a filter maker 50 for the production of a hollow filter body, for example to be used as a filter or as a filter component in an aerosol forming article (not depicted in the figures).

Figure 1:
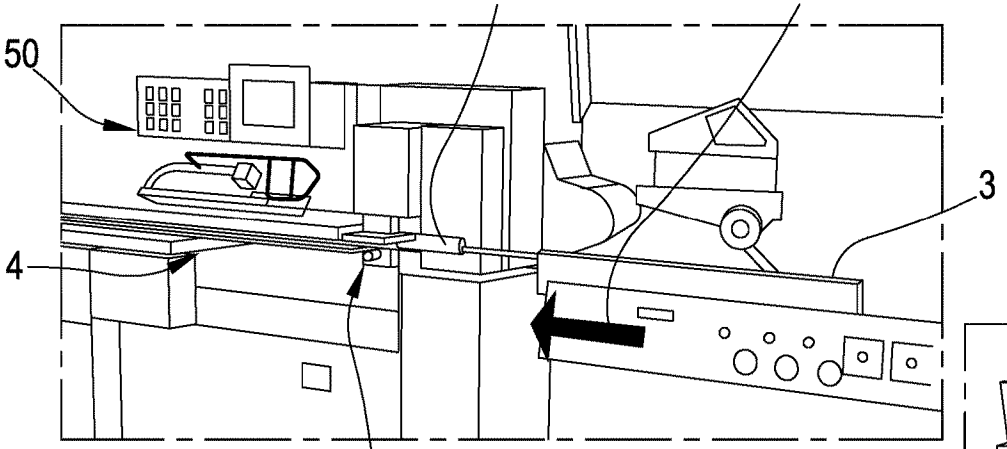
FIG. 1 is a perspective view of a filter maker in which the elongated object are inserted according to the method and using the apparatus of the invention.

The filter maker 50 comprises a transport device 3 to transport along a transport or feeding direction 30 (indicated by arrows in the figures) filter material, for example cellulose acetate or filter tow. The filter tow may be taken from a bundle (not shown). After the withdrawal from the bundle, the filter tow material by means of compressed air from different compressed air nozzles (also not shown) may be loosened up and homogenized.

Further, the filter maker 50 includes an inlet unit 2 adapted to form a continuous stream or strip of filter material, moistened with a hardening fluid or plasticizer, such as triacetin. The filter material is fed to the inlet unit 2 by the transport device 3. The moistening of the filter material with plasticizer takes place in a plasticizer unit, not shown in the drawings and known in the art. The plasticizer unit is located upstream the inlet unit 2.

After the impregnation unit, the transport device 3 transports the impregnated filter tow material to the inlet unit 2, which includes preferably a cone-shaped element 54. In the inlet unit 2, the filter tow material is subjected to compressed air. This procedure may cause homogenization of the filter tow material, which is pushed along an interior channel (not shown) of the inlet unit 2 realized along a longitudinal direction of the inlet unit itself. The interior channel is preferably cylindrically shaped and it defines a longitudinal axis preferably parallel to the transport direction 30.

Downstream the inlet unit 2, the apparatus includes a rod forming unit 4, arranged in series to the inlet unit 2 and adapted to receive the flow or strip of filter material and to cause the hardening material present in the filter material to react to transform the filter material into a continuous axially rigid hollow rod filter body.

Preferably, the hollow filter body exiting the rod forming unit 4 is a non-wrapped acetates filters (NWA filters). In order to avoid an expansion of the rod filter body after shaping it in the rod forming unit 4, without such a wrapping paper presence, such as in standard filters, inside the rod forming unit 4 the filter material receives already during its shaping a sufficiently large stability, so that it is used and processed without the wrapping paper.

The rod forming unit 4 is considered known in the art and not further described herein.

Figure 2:
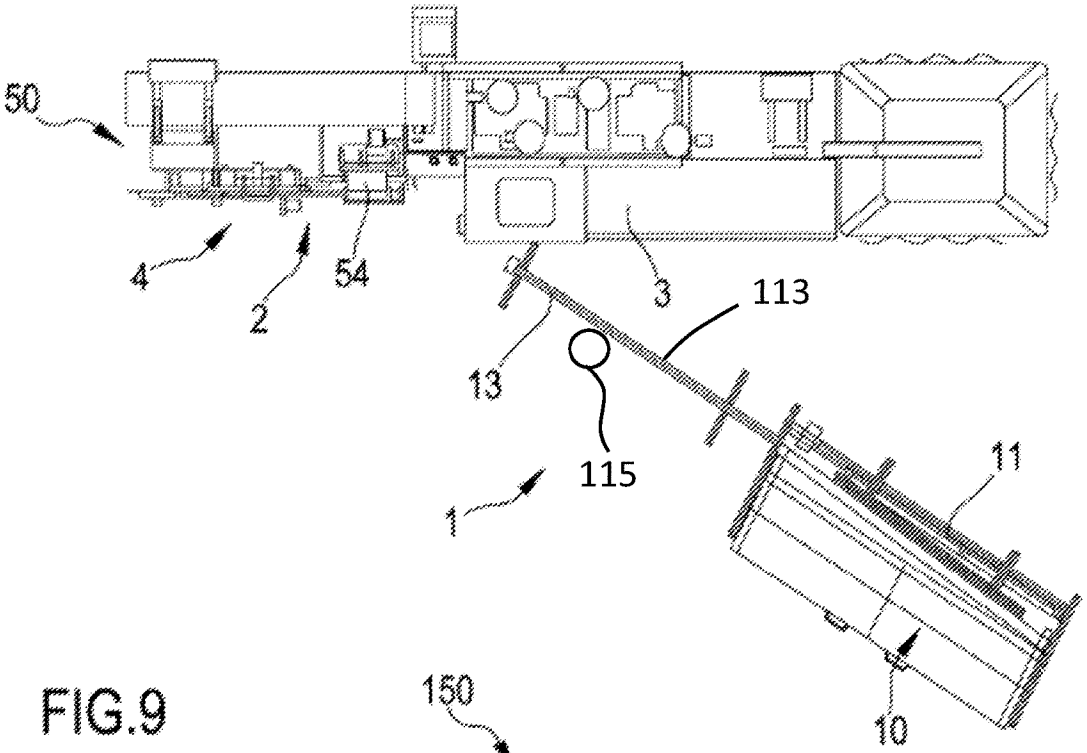
FIG. 2 is a top view of the filter maker of FIG. 1 connected to an apparatus for the insertion of elongated object according to the invention.

According to the invention, an apparatus 1 for inserting into the filter maker 50 elongated objects 100 is coupled to the filter maker 50, as depicted in FIG. 2. Although in this embodiment the apparatus 1 is coupled to the filter maker 50, the apparatus 1 can be used for the insertion of elongated objects in any machine, besides the filter maker, preferably for the production of filters. Preferably, the speed of the filter maker 50 is of at least about 150 filters per minute and the insertion of elongated objects according to the method and apparatus of the invention is preferably not decreasing this output speed.

Figure 9:
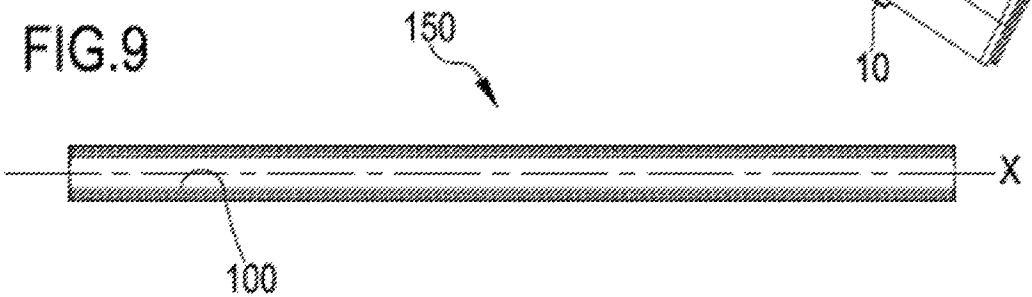
FIG. 9 is a lateral view in section of a final product obtained by the apparatus or method of the invention.

The elongated objects 100 may be hollow tubes, such as carton tubes, which will form an inner part of the hollow filter produced by the filter maker 50, that is, the elongated object is—in the final product—surrounded by the filter tow material which form a sleeve around the elongated object in the form of the tube. An example of an elongated object 100 in a finished product 150, such as a hollow filter, is given in FIG. 9. The elongated object 100 is a carton tube which is inserted in a filter material, forming a hollow filter 150. The longitudinal axis X of the elongated object 100 is the axis of the tube. The length of a single elongated object 100 at insertion can be of several meters.

Figure 3:
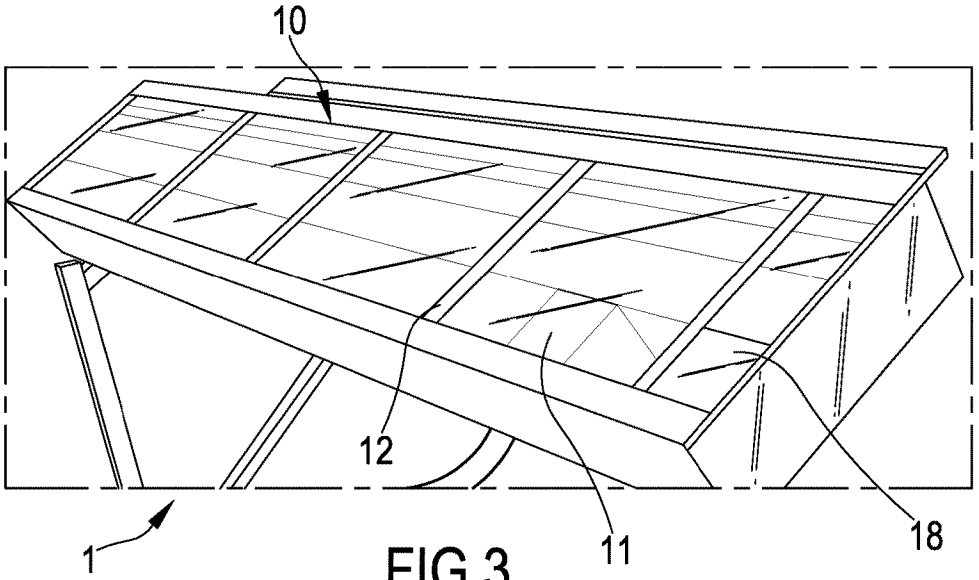
FIG. 3 is a perspective view of a first portion of the apparatus of the invention.
Figure 5:
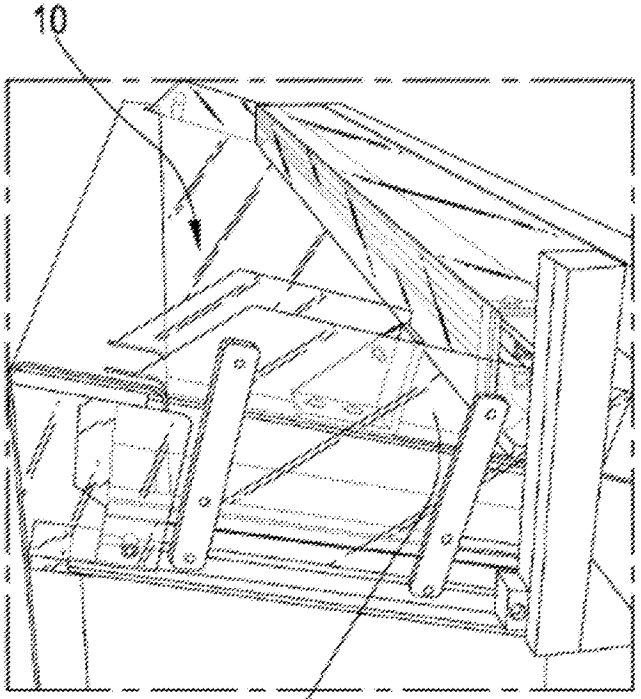
FIG. 5 is a further perspective view of the portion of the apparatus of FIG. 3.

The apparatus 1 includes, with now reference to FIGS. 3 and 5, a reservoir 10 where the elongated objects are inserted. The elongated objects may be placed in the reservoir 10 manually by an operator or automatically. The length of the reservoir 10 is variable and an adjustment could be performed in order to accommodate elongated objects having different sizes, that is, having different lengths along their longitudinal axes X.

A transfer chamber 11 is connected to the reservoir. In the transfer chamber 11, the elongated objects 100, from the disordered—that is, from a randomly aligned phase—present in the reservoir 10, change to a phase where they are aligned with their longitudinal axes substantially parallel one to the other. In order to obtain this alignment, a vibrating zone 12 is formed, preferably within the transfer chamber, where suitable vibrating means are positioned. Due to vibrations and to the shape of the transfer chamber as detailed below, the elongated objects from a random two-dimensional distribution in the reservoir 10 align into to a substantially single line distribution.

Figure 6:
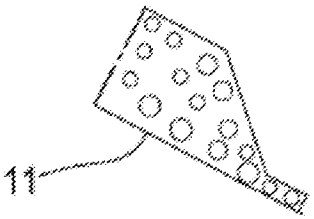
FIG. 6 is a schematic lateral cross section of a part of the portion of FIGS. 3 and 5.
Figure 8:
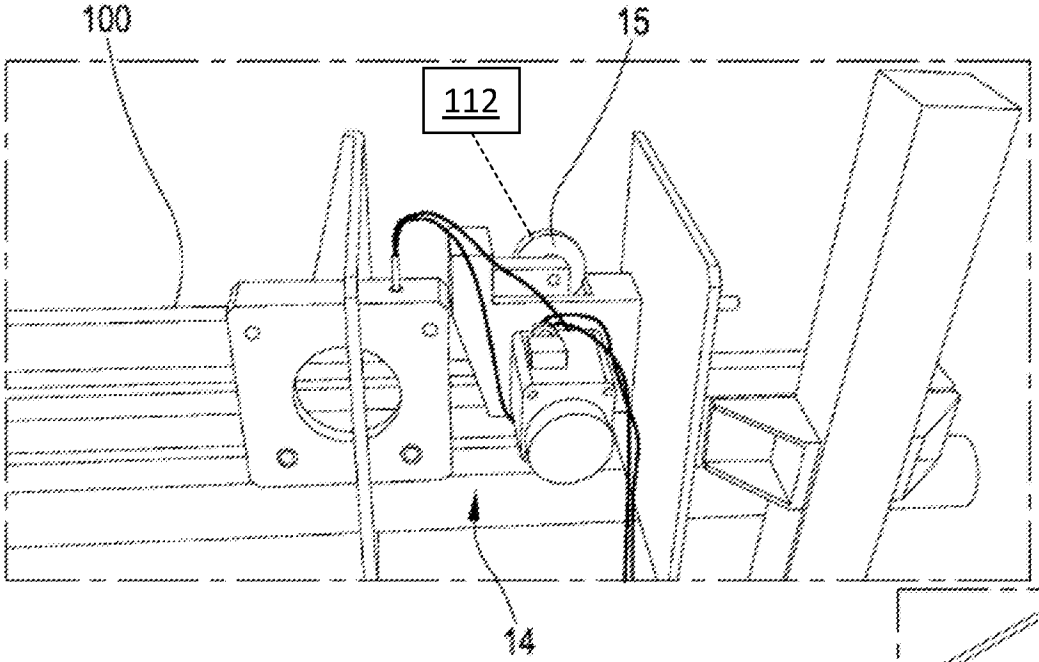
FIG. 8 is a perspective view of a fourth portion of the apparatus of the invention.

For example, the transfer chamber 11 may have a hopper-like shape as depicted in FIG. 6. The hopper has a funnel shape at one of its ends. The funnel shape decreases the size of the hopper and elongated objects may enter the funnel part of the hopper only if aligned with their axes parallel to each other. Two overlapping elongated object may not enter the funnel like shape of the hopper 11. The elongated objects 100 in the hopper 11 are rearranged by means of the relative movement of the vibrating means 12 with respect to the hopper 11. The funnel-like shape of the hopper 111 and the vibrating movements push the elongated objects towards an exit hole (not shown) of the hopper. Preferably, the elongated objects 100 have a generally cylindrical shape with the longitudinal axis X extending centrally. The hole has a dimension which allows the exit of an elongated object only if substantially aligned, that is perpendicular to the hole itself. Therefore, in order to exit the hopper 11, the elongated objects need to be aligned along the same direction.

Figure 7:
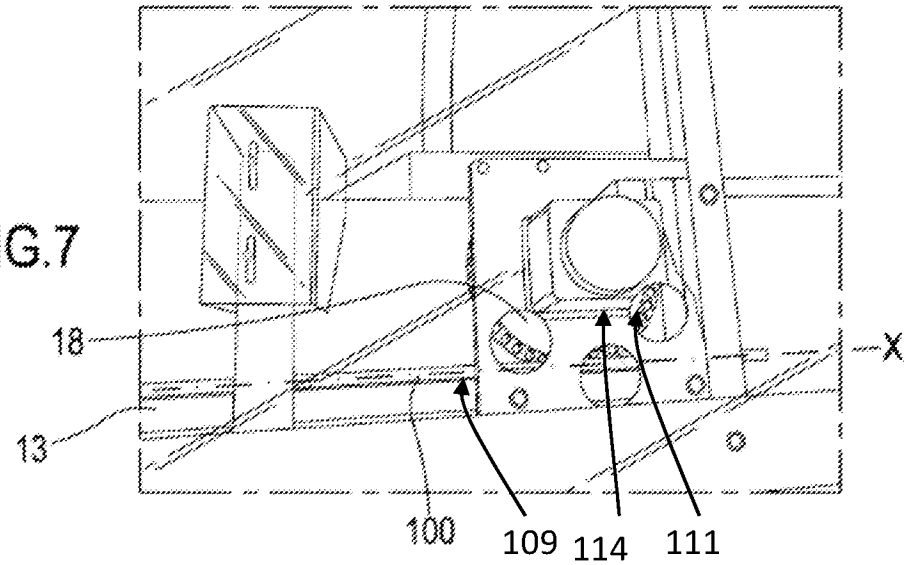
FIG. 7 is a perspective view of a third portion of the apparatus of the invention, which apparatus comprises a housing 114.

Outside the hole of the hopper 11, a rotatable wheel 18 is located, which engages with the elongated objects 100 exiting the hole aligned one after the other, as depicted in FIGS. 3 and 7. The wheel is located in the lower part of the hopper, on the right side, directly connected with the exiting hole. The wheel defines an outer surface (not visible in the drawings) which includes a cylindrical surface defining the rim of the wheel 18. The wheel 18 is positioned so that its rotation axis is substantially perpendicular to the longitudinal axis X of the elongated objects exiting the hopper 11. A top view of the wheel 18 therefore shows that the projection of the outer surface on a plane containing the longitudinal objects is substantially parallel to their longitudinal X axis. The speed of rotation of the wheel 18 can be adjusted by suitable regulators 114.

Figure 4:
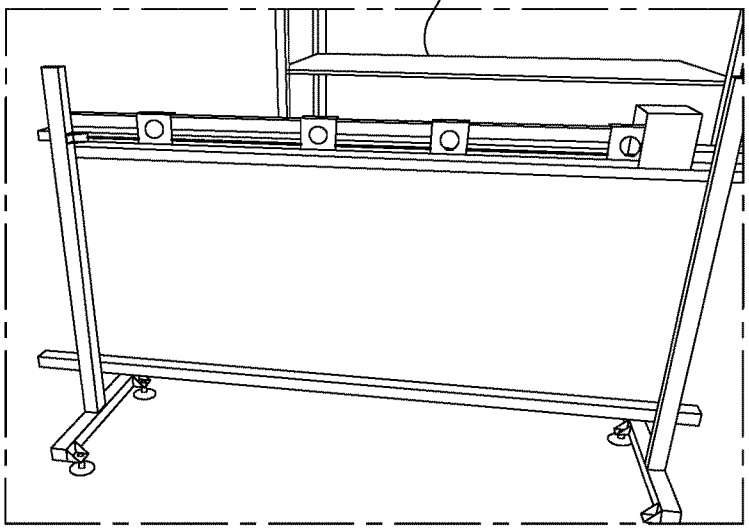
FIG. 4 is a perspective view of a second portion of the apparatus of the invention.

The wheel therefore engages a single elongated object per time unit. The elongated object is sandwiched between a bottom surface of the transfer chamber 11 and the outer surface of the wheel. Due to the fact that the wheel 18 engages a single elongated object per time unit, the elongated objects are removed one by one from the hopper 11 and transferred to a delivery channel 13 (shown in an enlarged view in FIG. 4).

The elongated objects 100 are fed to the delivery channel 13 at an outlet 109 of the rotating wheel 18 with a selected speed which is imparted by the rotating wheel 18. The wheel for example may have a dedicated motor (not shown) having a variable speed so that the speed of the wheel can be regulated. The wheel 18 preferably includes a plurality of holes 111 where suction is generated. This suction help to grip the elongated object 100 and accelerate the same to the delivery channel 13 from a speed equal initially to zero to a defined pre-selected speed. Preferably, at the exit from the wheel 18 and at the inlet of the delivery channel 13, the speed of the elongated object 100 is higher than the speed of the flow of the filter material at the inlet of the inlet unit 2 of the filter maker 50, more preferably higher than the speed of the filter material flow at the cone-shaped element 54, where the elongated object 100 is inserted into the filter material flow. The speed of the elongated object at the inlet of the delivery channel 13 is for example about 5 percent higher than the filter maker speed.

The delivery channel 13 includes preferably a single rail in which the elongated objects 100 accelerated by the wheel are aligned one after the other along their longitudinal axes X. A single line path is therefore defined, where the different elongated objects are substantially attached one to the other with their opposite axial ends to substantially form a continuous flow of elongated objects. The speed value of the elongated objects at the inlet of the transport channel 13 given by the wheel 18, speed which is higher than the filter maker speed, allows positioning the elongated objects in the delivery channel as close as possible.

Preferably, the delivery channel 13 includes a sensor system 115 which measures the distance between the adjacent elongated objects 100 along a single line path in the delivery channel 13, that is, measures the length of the empty spaces between elongated objects 100, and this measure is sent as a feedback for example to the control speed of the motor if the wheel 18 to change or adjust the speed of the wheel in order to minimize the measured distance.

The delivery channel 13 connects the apparatus 1 to the filter maker 50 and the rail forms a single line path to feed the elongated objects 50 one by one to the cone-shaped element 50, also called jet air nozzle. Any curve or bend present in the single line path formed in the delivery channel 13 is preferably realized with a bending radius that minimize possible damages in the elongated objects 100.

The elongated objects in the delivery channel 13 have a speed defined by the speed of the wheel and can be transported only one after the other in a single line.

At the exit of the transport channel 13, before the elongated object is inserted into the jet air nozzle, which serves as the location 54 where the elongated object is introduced into the continuous flow of material, a speed adjustment unit 14 is located, for example including a couple of pulleys 15 actuated by an independent motor operably coupled to regulator 112. The speed adjustment unit includes a regulator 112 that regulates the speed of the elongated object to be inserted depending on the speed of the filter maker machine, more preferably depending on the speed of the material in which the elongated object is inserted. Preferably, the speed of the pulleys is so regulated that the speed of the elongated objects 100 at their insertion in the jet air nozzle at location 54 is substantially equal to the speed of the filter material also flowing into the jet air nozzle at location 54.

The functioning of the apparatus 1 is as follows, according to the method of the invention.

Elongated objects 100 are inserted in the reservoir 10 with a random orientation and from there, preferably with the aid of vibration means in a vibration area 12, they are transferred into a hopper 11 where they align, that is, where they become arranged with their longitudinal axes X substantially parallel one to the others. The elongated objects 100 exit the hopper 11 one by one, pulled by a rotatable wheel that accelerates the elongated objects sucking the same from its peripheral surface. The elongated objects 100 are accelerated along a line path which is substantially parallel to their longitudinal axes X. At the exit of the wheel 18, the elongated objects 100 enter a delivery channel 13 where they travel with a given speed, thanks to the imparted acceleration by the wheel 18, along a single line path one after the other. The delivery channel comprises a guiding rail 113 to guide the elongated objects in the single line path to the location 54 where the objects are to be introduced into the continuous flow of material. The speed of the elongated objects is further regulated at the exit of the delivery channel 13 by the speed adjustment unit 14 which may change the speed of the elongated objects 100 before their insertion into the filter material of a filter maker to a speed dependent to the speed of the material flowing in the filter maker.

At the filter maker 50, the elongated objects 100 are inserted one by one into the flow of filter material therein present, flow of material which may further surround the elongated objects.

The insertion of elongated objects into the flow of material of the filter maker is substantially continuous due to the minimized distance between consecutive elongated objects.

The method and apparatus of the invention therefore manage the insertion of elongated objects having different lengths, is adapted to align the same and is capable to handle their transport and insertion, one by one, in sequential and synchronized way to the filter maker, matching equipment speed (150 m/min minimum).

The invention claimed is:

1. A method for introducing elongated objects defining a longitudinal axis into a continuous flow of material, the method comprising the steps of:

providing a reservoir for holding the elongated objects to be introduced into the continuous flow of material;

introducing the elongated objects from the reservoir into a transfer chamber that is arranged such that the objects are aligned such that their respective longitudinal axis is substantially parallel one to the other;

moving the elongated objects in a single line path from the transfer chamber to a delivery channel by a rotatable wheel, the rotatable wheel arranged adjacent the transfer chamber and adapted to move the elongated objects located in the transfer chamber by contacting the elongated objects with a peripheral surface of the rotatable wheel, wherein moving the elongated objects in the single line path from the transfer chamber to the delivery channel comprises sandwiching the elongated objects, one by one, between a surface of the transfer chamber and the peripheral surface of the wheel such that the elongated objects move in the single line path as the wheel rotates;

inserting the elongated objects from the delivery channel to a location where the elongated objects are to be introduced into the continuous flow of material; and regulating an insertion speed of insertion of the elongated object from the delivery channel to the location where the elongated objects are to be introduced into the continuous flow of material on the basis of a speed of the continuous flow of material at the location in which the elongated object is to be introduced.

2. The method according to claim 1, comprising the step of:

regulating a rotational speed of the rotatable wheel so that the elongated objects in their motion in a single line path from the transfer chamber to the delivery channel are accelerated to a speed equal to or higher than the speed of the continuous flow of material at the location in which the elongated object is to be introduced.

3. The method according to claim 1, comprising:

measuring a distance in the delivery channel between two adjacent elongated objects in the single line path; and changing a rotational speed of the rotatable wheel depending on the measured distance.

4. The method according to claim 1, comprising:

vibrating the elongated objects in the transfer chamber.

5. The method according to claim 1, wherein the step of regulating an insertion speed of insertion of the elongated object from the delivery channel to a location where the elongated objects are to be introduced comprises:

regulating the insertion speed so that it is substantially identical to the speed of the continuous flow of material at the location in which the elongated object is to be introduced.

6. The method according to claim 1, wherein the step of contacting the elongated objects with a peripheral surface of the rotatable wheel comprises:

sucking the elongated object against the peripheral surface of the rotatable wheel.

7. The method according to claim 1, comprising:

changing a length of the reservoir on the basis of a length of the elongated object along the longitudinal axis.

8. The method according to claim 1, wherein rotation of the rotatable wheel is configured to cause linear movement of the elongate objects along their respective longitudinal axes.

9. Apparatus for introducing elongated objects defining a longitudinal axis into a continuous flow of material, the apparatus comprising:

a reservoir for holding the elongated objects to be introduced into the continuous flow of material;

a transfer chamber connected to the reservoir and arranged such that the objects are aligned such that their respective longitudinal axis is substantially parallel one to the other;

a rotatable wheel having a peripheral surface, the wheel being arranged adjacent the transfer chamber and adapted to move the elongated objects located in the transfer chamber to a delivery channel in a single line path by contacting the elongated objects with a peripheral surface of the rotatable wheel, wherein the rotatable wheel and a surface of the transfer chamber are arranged such that the elongated objects are configured to be sandwiched between the surface of the chamber and the peripheral surface of the rotatable wheel and cause the elongated objects to move in the single line path from the transfer chamber to the delivery channel as the wheel rotates;

the delivery channel connecting an outlet of the rotatable wheel to a location where the elongated objects are to be introduced into the continuous flow of material; and a regulator to modify an insertion speed of insertion of the elongated objects from the delivery channel to a location where the elongated objects are to be introduced into the continuous flow of material on the basis of a speed of the continuous flow of material at the location in which the elongated object is to be introduced.

10. The apparatus according to claim 9, wherein the peripheral surface of the rotatable wheel includes one or more suction openings for generating a negative pressure causing the elongated object to move towards the peripheral surface of the transfer wheel.

11. The apparatus according to claim 9, including a sensor system connected to the delivery channel adapted to measure the distance between two adjacent elongated objects in a single line path transported therein.

12. The apparatus according to claim 9, wherein the regulator comprises one or more pulleys.

13. The apparatus according to claim 9, wherein the delivery channel comprises a guiding rail to guide the elongated objects in a single line path to the location where the elongated objects are to be introduced into the continuous flow of material.

14. The apparatus according to claim 9, comprising a rotational speed regulator to modify a rotational speed of the rotatable wheel.

15. The apparatus according to claim 9, wherein rotation of the rotatable wheel is configured to cause linear movement of the elongate objects along their respective longitudinal axes.

* * * * *